US009697816B2

(12) United States Patent
Osuga et al.

(10) Patent No.: US 9,697,816 B2
(45) Date of Patent: Jul. 4, 2017

(54) KEYBOARD UNIT

(71) Applicant: YAMAHA CORPORATION, Hamamatsu-shi, Shizuoka (JP)

(72) Inventors: Ichiro Osuga, Hamamatsu (JP); Michiko Yoshimura, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/014,196

(22) Filed: Feb. 3, 2016

(65) Prior Publication Data

US 2016/0225359 A1 Aug. 4, 2016

(30) Foreign Application Priority Data

Feb. 4, 2015 (JP) ..... 2015-020121

(51) Int. Cl.
*G10H 1/18* (2006.01)
*G10H 1/34* (2006.01)

(52) U.S. Cl.
CPC ..... *G10H 1/344* (2013.01); *G10H 1/18* (2013.01); *G10H 2220/271* (2013.01); *G10H 2220/281* (2013.01); *G10H 2230/011* (2013.01)

(58) Field of Classification Search
CPC ..... G10H 1/18
USPC ..... 84/615
See application file for complete search history.

(56) References Cited

U.S. PATENT DOCUMENTS

| | | | | |
|---|---|---|---|---|
| 3,536,819 | A | 10/1970 | Kuriyagawa et al. | |
| 3,794,747 | A | 2/1974 | Obayashi | |
| 4,031,797 | A | 6/1977 | Schmoyer | |
| 4,416,178 | A | 11/1983 | Ishida | |
| 5,079,985 | A | 1/1992 | Yamaguchi et al. | |
| 5,237,123 | A * | 8/1993 | Miller | G10G 3/04 84/21 |
| 5,512,705 | A * | 4/1996 | Kobayashi | G10H 5/007 24/624 |
| 5,612,502 | A | 3/1997 | Ura | |
| 5,679,914 | A | 10/1997 | Niitsuma | |

(Continued)

FOREIGN PATENT DOCUMENTS

| | | | |
|---|---|---|---|
| JP | S57104994 | A | 6/1982 |
| JP | H07104737 | A | 4/1995 |

(Continued)

OTHER PUBLICATIONS

Notice of Allowance issued in U.S. Appl. No. 15/013,373, mailed Aug. 30, 2016.

(Continued)

*Primary Examiner* — David Warren
(74) *Attorney, Agent, or Firm* — Rossi, Kimms & McDowell LLP

(57) ABSTRACT

A keyboard unit includes: a key; a displacement member which is configured to be driven directly or indirectly with the key by a pressing operation of the key to be moved in a forward stroke direction; a detector which is configured to detect that an operation direction of the displacement member has changed from the forward stroke direction to a returning direction; and a generator which is configured to generate sound generation indication information based on information detected by the detector.

12 Claims, 10 Drawing Sheets

(56) References Cited

U.S. PATENT DOCUMENTS 5,691,489 A * 11/1997 Fujiwara ..... G10F 1/02 84/115
5,731,530 A * 3/1998 Fujiwara ..... G10F 1/02 84/115
5,739,450 A * 4/1998 Fujiwara ..... G10F 1/02 84/20
5,763,799 A 6/1998 Kimble
5,977,466 A 11/1999 Muramatsu
5,986,202 A 11/1999 Seiler
6,051,762 A * 4/2000 Fujiwara ..... G10F 1/02 84/115
6,191,351 B1 2/2001 Niitsuma
6,297,437 B1 * 10/2001 Ura ..... G10H 1/0553 84/18
6,365,820 B1 4/2002 Kondo et al.
6,765,142 B2 7/2004 Sakurada et al.
7,214,897 B2 5/2007 Chuang
7,361,827 B2 * 4/2008 Sasaki ..... G10H 1/346 84/723
7,408,108 B2 8/2008 Ludwig
7,423,867 B2 9/2008 Yamamoto et al.
7,432,430 B2 * 10/2008 Sasaki ..... G10F 1/02 84/462
7,820,902 B2 * 10/2010 Furukawa ..... G10H 1/0058 84/609
7,902,449 B2 * 3/2011 Furukawa ..... G10H 1/0066 84/462
7,960,629 B2 * 6/2011 Sasaki ..... G10F 1/02 84/20
2002/0046640 A1 4/2002 Kondo
2005/0145104 A1 * 7/2005 Sasaki ..... G10H 1/344 84/746
2006/0048624 A1 * 3/2006 Sasaki ..... G10F 1/02 84/13
2006/0054010 A1 * 3/2006 Sasaki ..... G10H 1/346 84/744
2006/0065103 A1 * 3/2006 Sasaki ..... G10F 1/02 84/600
2007/0039452 A1 2/2007 Nishida
2007/0169608 A1 * 7/2007 Fujiwara ..... G10G 3/04 84/13
2007/0221036 A1 * 9/2007 Fujiwara ..... G10F 1/02 84/21
2009/0084248 A1 * 4/2009 Furukawa ..... G10H 1/0058 84/609
2009/0100979 A1 * 4/2009 Furukawa ..... G10H 1/0066 84/13
2010/0229707 A1 * 9/2010 Sasaki ..... G10F 1/02 84/20
2010/0288102 A1 * 11/2010 Fujiwara ..... G10F 1/02 84/13
2010/0294108 A1 * 11/2010 Shin ..... G10C 3/161 84/236
2011/0132182 A1 * 6/2011 Kikumoto ..... G10H 1/0551 84/744
2013/0152769 A1 6/2013 Suzuki et al.
2014/0069262 A1 * 3/2014 Cheever ..... G10H 1/38 84/613
2016/0225359 A1 * 8/2016 Osuga ..... G10H 1/344
2016/0225360 A1 8/2016 Osuga et al.

FOREIGN PATENT DOCUMENTS

JP H08101687 A 4/1996
JP 09120286 A 5/1997
JP 09120287 A 5/1997
JP 09120288 A 5/1997
JP 09120289 A 5/1997
JP 2001312279 A 11/2001
JP 2007052357 A 3/2007
JP 2010160263 A 7/2010
JP 2013210451 A 10/2013

OTHER PUBLICATIONS

Office Action issued in U.S. Appl. No. 15/014,349, mailed Aug. 24, 2016.
Notice of Allowance issued in U.S. Appl. No. 15/014,349 mailed Jan. 10, 2017.
Notice of Allowance issued in U.S. Appl. No. 15/013,373, mailed Nov. 18, 2016.
Office Action issued in Japanese Appln. No. 2015-020122 mailed Nov. 29, 2016. English machine translation provided.

* cited by examiner

| KEY |
|---|
| KEY 1 |
| KEY 2 |
| ⋮ |
| KEY 88 |

| SW | STATE | CHANGE TIME |
|---|---|---|
| SW2 | OFF | hh:mm:ss:xxxxx |
| SW3 | ON | hh:mm:ss:xxxxx |
| SW4 | ON | hh:mm:ss:xxxxx |
| SW5 | OFF | hh:mm:ss:xxxxx |
| SW6 | OFF | hh:mm:ss:xxxxx |
| SW7 | OFF | hh:mm:ss:xxxxx |
| SW8 | OFF | hh:mm:ss:xxxxx |

KEYBOARD UNIT

CROSS-REFERENCE TO RELATED APPLICATION(S)

This application is based upon and claims the benefit of priority from prior Japanese patent application No. 2015-020121, filed on Feb. 4, 2015, the entire contents of which are incorporated herein by reference.

BACKGROUND

The present invention relates to a keyboard unit having a displacement member that is displaced in a forward stroke direction and a returning direction by key pressing/releasing operation.

Keyboard musical instruments are available that have a displacement member, such as a hammer or the like, that is driven directly or indirectly with a key by the pressing operation of the key and is displaced (moved) in a forward stroke direction. In this kind of musical instrument, a keyboard musical instrument is also available in which the operation of a key or a displacement member is detected and musical sound is controlled on the basis of the result of the detection. For example, in the technology disclosed in JP-A-2010-160263, three or more contact sections that are turned ON sequentially according to key pressing operation are provided, and the key pressing velocity and sound generation timing are controlled when two contact sections corresponding to a designated performance style are turned ON sequentially.

Generally, in a musical instrument in which the operation of a displacement member, such as a hammer, operating in synchronization with a key is used for musical sound control, the control is carried out on the implicit premise that the displacement member operates almost accurately in synchronization with the key in all performance styles.

However, in reality, for example, the key and the hammer do not always operate accurately in synchronization with each other, and the relative relationship between the key and the hammer is complicated depending on various key pressing and releasing operation modes, such as the strength and depth of key pressing operation and the timing of key releasing operation. A case is taken as an example in which although the key is moving in the forward stroke direction, the hammer is moving in the returning direction after making contact with a string or a stopper and being bounced back thereby. In this kind of case, if musical sound is controlled on the basis of only the result of the detection that the hammer has reached a specific position in the forward stroke direction, accurate musical sound control cannot always be carried out in some cases. The player of the musical instrument may feel uncomfortable in some cases, for example, because the timing of key pressing operation does not coincide with the timing of sound generation or the strength of pressing the key does not match the volume of the generated sound.

SUMMARY

The presently invention may provide a keyboard unit capable of appropriately determining the timing of sound generation.

The keyboard unit may comprise: a key; a displacement member which is configured to be driven directly or indirectly with the key by a pressing operation of the key to be moved in a forward stroke direction; a detector which is configured to detect that an operation direction of the displacement member has changed from the forward stroke direction to a returning direction; and a generator which is configured to generate sound generation indication information based on information detected by the detector.

The detector may include a first detection section which maintains ON state only when the displacement member is located at a position deeper than a predetermined position in an operation range of the displacement member in the forward stroke direction, and the generator may be configured to determine a timing at which the first detection section turns from ON to OFF, as a sound generation timing.

The generator may be configured to determine a key pressing velocity of the key based on a time difference from a time when the first detection section turns ON to a time when the first detection section tunes from ON to OFF.

The keyboard unit may further comprise: a key detection section which is configured to detect that the key has been pressed. The generator may be configured to determine a key pressing velocity based on at least one of: a time difference from a time when the key detection section detects the pressing operation of the key to a time when the first detection section turns ON; a time difference from a time when the key detection section detects the pressing operation of the key to a time when the first detection section turns from ON to OFF; and a time difference from a time when the first detection section turns ON to a time when the first detection section tunes from ON to OFF, after the key detection section detects the pressing operation of the key.

The detector may include a second detection section which turns ON each time the displacement member passes through a predetermined position in the forward stroke direction or the returning direction, and in a case that the second detection section has turned ON two times in succession within a certain time, the generator may be configured to determine a timing at which the second detection section turns ON second, as a sound generation timing.

The generator may be configured to determine a key pressing velocity based on a time difference from a time when the second detection section turns ON first to a time when the second detection section turns ON second, within the certain time.

The keyboard unit may further comprise: a key detection section which is configured to detect that the key has been pressed. The generator may be configured to determine a key pressing velocity based on at least one of: a time difference from a time when the key detection section detects the pressing operation of the key to a time when the second detection section turns ON first; a time difference from a time when the key detection section detects the pressing operation of the key to a time when the second detection section turns ON second; and a time difference from a time when the second detection section turns ON first to a time when the second detection section turns ON second, within the certain time, after the key detection section detects the pressing operation of the key.

An operation end position of the displacement member in the forward stroke direction may be restricted by a restricting member, and the predetermined position may be located closer to an operation start position of the displacement member than the operation end position in the operation range of the displacement member in the forward stroke direction, and be located within 30% of the operation range from the operation end position.

Musical sound may be generated based on the sound generation indication information generated by the generator.

The sound generation indication information generated by the generator may be output to an external device.

The sound generation indication information generated by the generator may be stored in a storage.

There may be also provided a keyboard musical instrument comprising the keyboard unit.

The keyboard unit may comprise: a key; a hammer which is configured to be driven directly or indirectly with the key by a pressing operation of the key to be moved in a forward stroke direction; a detection section which is configured to detect that an operation direction of the hammer has changed from the forward stroke direction to a returning direction; and a control circuit which is configured to generate sound generation indication information based on information relating to the hammer and detected by the detection section.

DETAILED DESCRIPTION OF EXEMPLARY EMBODIMENTS

Embodiments according to the present invention will be described below referring to the accompanying drawings.

(First Embodiment)

Figure 1:
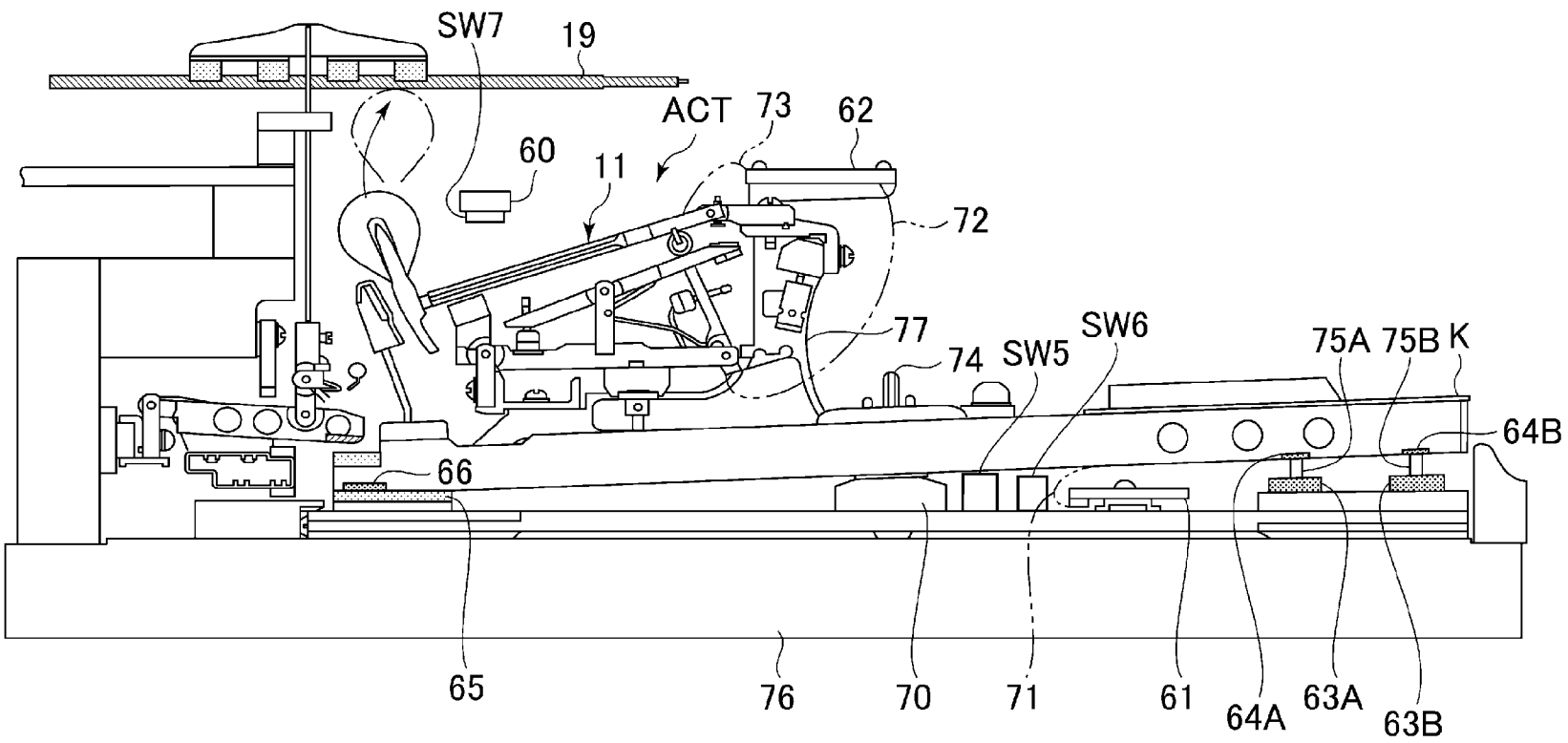
FIG. 1 is a vertical cross-sectional view showing a keyboard unit according to a first embodiment of the present invention.

FIG. 1 is a vertical cross-sectional view showing a keyboard unit according to a first embodiment of the present invention. FIG. 1 mainly shows the configurations of a key K and an action mechanism ACT for the key, for example.

This keyboard unit is configured as part of a grand piano type electronic keyboard musical instrument in which a plurality of keys K, white keys and black keys, are arranged in parallel. The action mechanism ACT for each key K is provided above the rear end section of the key K. Each key K is disposed so as to be rotatable clockwise and counterclockwise in FIG. 1 with a portion near a balance pin 74 at a key fulcrum section 70 being used as a fulcrum. The right side in FIG. 1 is the side of the player and the front side of the keyboard unit, and the left side is the rear side thereof. The front section of the key K is pressed and released.

This keyboard unit can generate sound using a hammer 11 that strikes a string 19 and also can generate sound electronically by detecting the movements and positions of elements in the action mechanism ACT and the like. A silencing stopper 60 is mounted such that its position is variable with respect to a base section 76 including a keyboard reed so that the position of the silencing stopper 60 can be switched by operating an operation device, not shown. In the case of a normal performance in which the string is struck, the silencing stopper 60 is placed at a position where the hammer 11 does not make contact therewith. When a performance is carried out in a silencing mode, the silencing stopper 60 is placed at a position where the hammer 11 makes contact therewith so that the hammer 11 does not make contact with the string 19.

Front bushing cloths 64A and 64B are provided at the front lower section of the key K. Front punching cloths 63A and 63B are disposed at positions corresponding to the positions of the front bushing cloths 64A and 64B. The front bushing cloths 64A and 64B are made contact with the front punching cloths 63A and 63B by key pressing operation, whereby the turning end position (end position) of the key K is restricted. The movement of the front section of each key K in the arrangement direction of the keys is restricted by front pins 75A and 75B during key pressing operation.

A conductive section 66 is provided at the rear lower section of the key K. A back rail cloth 65 is disposed on the base section 76 via a back rail under felt at the position corresponding to the conductive section 66. The rear lower face of the key K makes contact with the back rail cloth 65, whereby the conductive section 66 makes contact with the back rail cloth 65, and the initial position of the key K in the non-pressing state of the key, that is, the turning start position (rest position) of the key K, is restricted.

An electric circuit board 61 is disposed so as to be fastened to the base section 76. In addition, an electric circuit board 62 is disposed so as to be fastened to an action bracket 77. Although electric circuit boards other than these are also provided, they are not shown in the figure.

Figure 2:
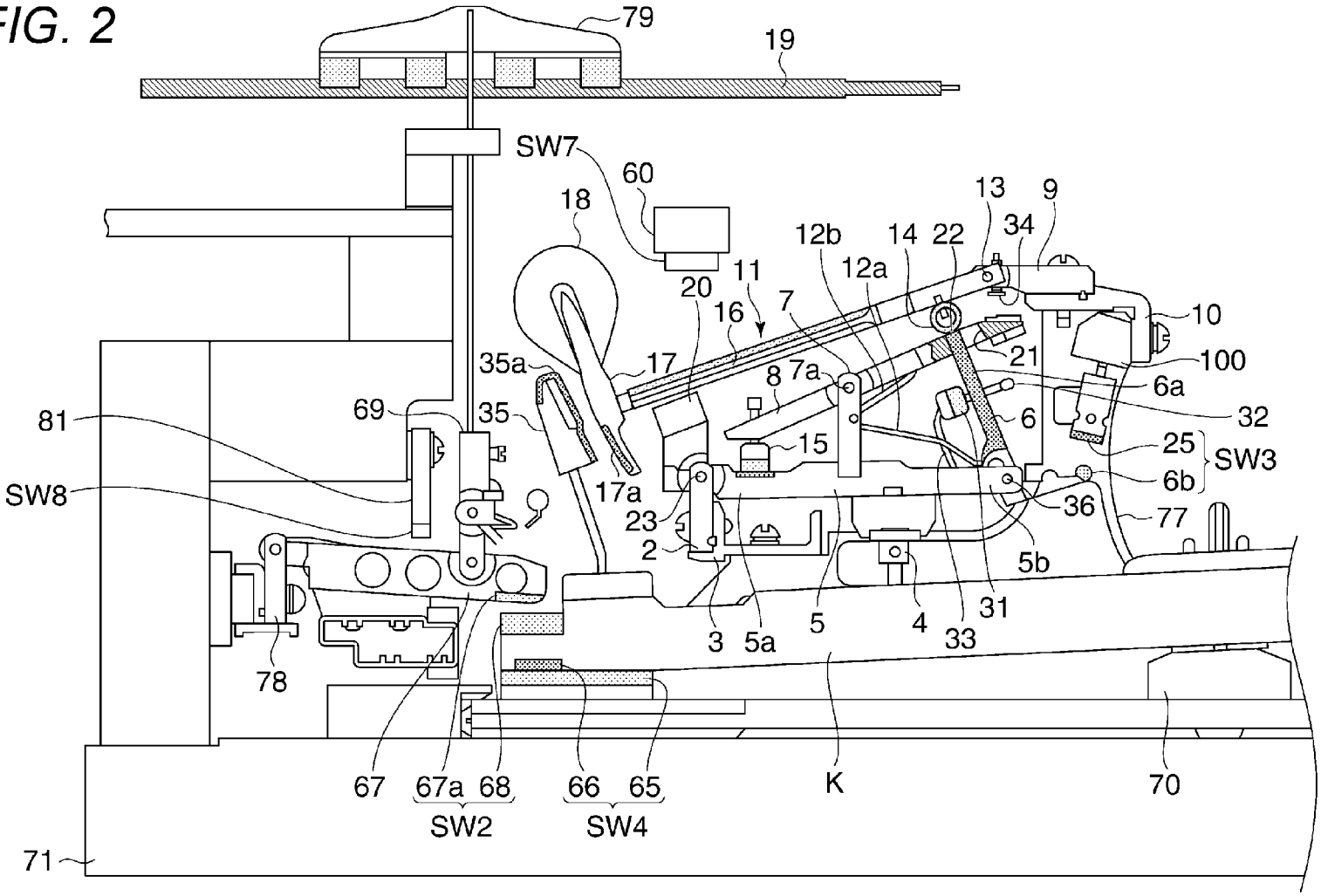
FIG. 2 is a side view showing an action mechanism and its peripheral elements.

FIG. 2 is a side view showing an action mechanism ACT and its peripheral elements.

A capstan screw 4 is implanted on the upper face of the rear end section of the key K. A back check 35 is provided at the rear end upper section of the key K. A damper lever 67 is pivotally supported by a damper lever flange 78 provided behind the key K. In addition, the damper lever 67 is pivotally supported by a damper block 69, and a damper 79 is fastened to the damper block 69.

The action mechanism ACT is mainly equipped with a wippen 5, a jack 6 and a repetition lever 8. The turning fulcrum 23 at the rear end section 5*a* of the wippen 5 is pivotally supported by a support flange 2 fastened to a support rail 3, and the front end 5*b* of the wippen 5 serving as a free end is made turnable around the turning fulcrum 23 in the up-down direction. A hammer shank stop felt 20 is disposed on the upper face of the wippen 5 on the side of the turning fulcrum 23. A jack stop 33 protrudes at the upper section of the front half section of the wippen 5.

A repetition lever flange 7 protrudes upward at the center of the wippen 5 in the front-rear direction. The repetition lever 8 is supported so as to be turnable clockwise and counterclockwise around the turning fulcrum 7*a* at the upper end section of the repetition lever flange 7. The jack 6 has a vertical section 6*a* extending nearly upward and a small jack 6*b* extending forward in a nearly horizontal direction, thereby being formed into a nearly L-shape in a side view. The jack 6 is disposed so as to be turnable clockwise and counterclockwise in FIG. 2 around the turning fulcrum 36 at the front end 5*b* of the wippen 5.

The jack stop 33 has a jack button screw 32 and a jack button 31 provided at the rear end section of the jack button screw 32. In the non-pressing state of the key (the releasing state of the key), the jack 6 makes contact with the jack button 31, whereby the initial position of the jack 6 is restricted and can be adjusted with the jack button screw 32.

A shank flange 9 is fastened to a shank rail 10. A regulating button 25 is provided on a regulating rail 100 mounted on the shank rail 10 so as to be adjustable in height with respect thereto. A repetition screw 34 is provided at the lower section of the shank flange 9. The hammer 11 is disposed above the repetition lever 8. The front end section of the hammer shank 16 of the hammer 11 is pivotally supported by the shank flange 9 so as to be turnable around a turning center 13 in the up-down direction. A hammer wood 17 is mounted at the rear end of the hammer shank 16 serving as a free end. A hammer felt 18 is mounted at the upper end of the hammer wood 17. A hammer roller 14 is provided near the front end section of the hammer shank 16.

In the non-pressing state of the key, the repetition lever 8 receives the hammer roller 14 from below at the upper face of the front end section thereof, thereby restricting the hammer 11 to its initial position. On the other hand, at the rear end section of the repetition lever 8, a repetition lever button 15 is disposed so as to be adjustable in height. This button 15 makes contact with the upper face of the rear end section 5*a* of the wippen 5, whereby the turning of the repetition lever 8 in the counterclockwise direction is restricted and the repetition lever 8 is restricted to its initial position.

A slot 21 is formed at the front end section of the repetition lever 8. The vertical section 6*a* of the jack 6 is inserted into the slot 21, and the top end face 22 of the vertical section 6*a* is almost flush with the upper face of the repetition lever 8.

In the above-mentioned configuration, in a normal key pressing forward stroke in which the key K being in its non-pressing state is pressed, the wippen 5 is pushed up by the rising of the capstan screw 4 and is turned around the turning fulcrum 23 counterclockwise, that is, in the forward stroke direction thereof. Since the wippen 5 is pushed up, the repetition lever 8 and the jack 6 are turned upward together with the wippen 5. With the turning of these elements, first, the repetition lever 8 and the vertical section 6*a* of the jack 6 push up the hammer 11 via the hammer roller 14 while allowing the hammer roller 14 to rotate and slide, thereby turning the hammer 11 upward.

On the other hand, with the turning of the key K in the forward stroke direction, a damper lever cushion 68 provided at the upper section of the rear end section of the key K pushes up the front end section of the damper lever 67. As a result, the damper 79 is raised via the damper block 69 and then the damper 79 (strictly speaking, damper felts provided at the lower section of the damper 79) is separated from the string 19.

Next, when the repetition lever 8 makes contact with and is engaged with the repetition screw 34, the displacement (the upper limit position) of the repetition lever 8 in the counterclockwise direction is restricted. Hence, the top end face 22 of the vertical section 6*a* of the jack 6 protrudes while passing through the slot 21 of the repetition lever 8, whereby the hammer roller 14 is driven by the top end face 22 and the hammer 11 is pushed up.

When the wippen 5 is turned further in the forward stroke direction, the small jack 6*b* of the jack 6 makes contact with the lower face of the regulating button 25 (strictly speaking, a regulating button punching) in the middle of the turning, and the rising of the small jack is stopped. However, since the wippen 5 itself is turned further, the jack 6 is turned clockwise around the turning fulcrum 36. Hence, the top end face 22 of the vertical section 6*a* of the jack 6 is moved away from the hammer roller 14 from the lower side to the front side and escapes therefrom. As a result, the hammer 11 is disengaged from the jack 6 and set to a free turning state, thereby striking the string 19. After striking the string, the hammer 11 is turned by its own weight and by the repulsion force of the string 19, thereby returning to its original position. However, in the silencing mode, the hammer shank 16 of the hammer 11 is restricted from turning by the silencing stopper 60, whereby the hammer 11 does not make contact with the string 19.

When the key pressing state is maintained after the end of the key pressing operation, the hammer wood 17 of the hammer 11 bounced back by the string 19 is received by the back check 35 (strictly speaking, a back check cloth 35*a*) and becomes stationary. When the key K is released and when the back check 35 is disengaged from the hammer 11, the repetition lever 8 is turned counterclockwise by the energizing force of a repetition energizing section 12*b*, and the hammer roller 14 is supported by the repetition lever 8.

Furthermore, after the string striking operation, as the wippen 5 is turned and returned to its original position, the jack 6 is released from the regulating button 25 and turned counterclockwise by the energizing force of a jack energizing section 12*a* and returned to its original position. Since the top end face 22 of the vertical section 6*a* of the jack 6 is returned quickly to the lower side position of the hammer roller 14, the next string striking operation can be carried out by pressing the key again, even if the key K is not returned completely to its non-pressing position. In other words, key pressing can be made quickly and repeatedly.

In the keyboard unit according to this embodiment, an element, the engagement state of which with an object to be engaged is changeable in the stroke of key pressing/releasing operation, is referred to as "a member." The member includes not only a single component but also component members configured as an integrated unit or members configured to be movable as an integrated unit. For example, the members correspond to the key K (key body) and the hammer 11 (hammer body), and also correspond to the elements intervened in the system ranging from the key K to the hammer 11 or elements for restricting the turning start positions and the turning stop positions of the key and the hammer 11. More specifically, in addition to the above-mentioned items, the elements designated by reference numerals 5, 6, 7, 8, 9, 11, 15, 19, 20, 25, 31, 34, 35, 60, 63, 65, 79, etc. can correspond to the members. The elements 64, 66 and 68 may be grasped as portions of the key K. The elements 14, 16, 17 and 18 may be grasped as portions of the hammer 11. The movable members other than the key K can correspond to displacement members. However, the members are not limited to these items taken as examples.

In the keyboard unit according to this embodiment, a plurality of detection sections SW (detection sections SW2 to SW8) including a detection section SW7 are provided for the key K. The detection sections SW detect the operations of the key K and the displacement members or the engagement states of the members to be engageable with each other. The detection section SW7 is disposed on the lower face of the silencing stopper 60. Hence, in the silencing mode, the hammer 11 makes contact with the detection section SW7 and indirectly makes contact with the silencing stopper 60 via the detection section SW7.

With this embodiment, while attention is paid to "displacement members" that are driven directly or indirectly with the key K by the pressing operation of the key so as to be displaced (moved) in the forward stroke direction and that are allowed to be moved in the returning direction by the releasing operation of the key K, musical sound information including the key pressing velocity of the key is generated and sound generation timing is determined. As a displacement member, the hammer 11 is first taken as an example. The detection section SW7 detects that the operation direction (vector) of the hammer 11 has changed from the forward stroke direction to the returning direction and determines the sound generation timing on the basis of the result of the detection, for example. All the detection sections SW2 to SW8 are not always required. The present invention is applicable in the case that a detection section capable of detecting that the operation direction of the displacement member has changed from the forward stroke direction to the returning direction is used as the detection section SW.

Figure 3A:
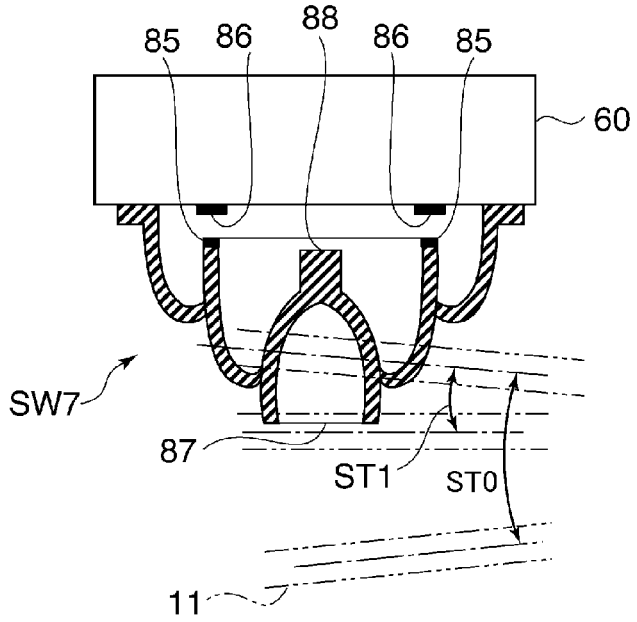
FIGS. 3A and 3C are cross-sectional views showing the configurations of detection sections.
Figure 3B:
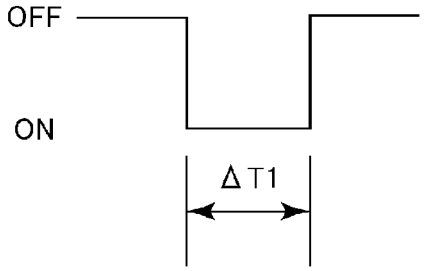
FIGS. 3B and 3D are views showing detection states.
Figure 3C:
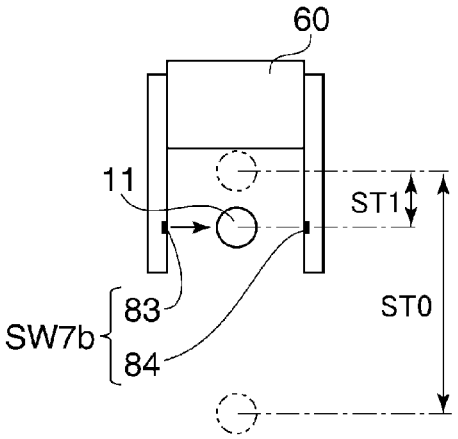
Figure 3D:
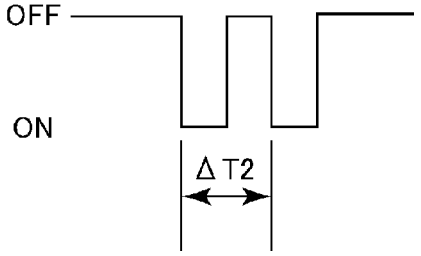

FIG. 3A is a cross-sectional view showing the configuration of the detection section SW7. The configuration shown in FIG. 3C is used for a second embodiment described later and thus not mentioned herein. As shown in FIG. 3A, the detection section SW7 is configured as a make-switch having a small pressing stroke and has a driven section 87 on the lower side thereof, the driven section 87 being expanded into a dome shape. When the driven section 87 is driven by the hammer 11, movable contacts 85 make contact with stationary contacts 86 provided on the lower face of the silencing stopper 60, whereby the detection section SW7 is electrically turned ON. Inside the dome, a stopper section 88 located farther away from the lower face of the silencing stopper 60 than the movable contacts 85 is provided.

The start point of the whole turning stroke ST0 serving as the operation range of the hammer 11 in the silencing mode is restricted when the hammer 11 makes contact with the repetition lever 8. On the other hand, the end point of the whole turning stroke ST0 is restricted when the stopper section 88 makes contact with the lower face of the silencing stopper 60. In the stroke of the hammer 11 in the forward stroke direction, the stroke ST1 from the position (predetermined position) in which the movable contacts 85 make contact with the stationary contacts 86 to the position in which the stopper section 88 makes contact with the lower face of the silencing stopper 60 is located within 30% of the whole stroke ST0. This 30% is determined on the assumption that the hammer 11 being displaced in the returning direction is received by the back check 35 at the position. The detection section SW7 serves as "a first detection section" that maintains its ON state only when the hammer 11 is located at a position deeper than the predetermined position.

The detection section SW8 (FIG. 2) has a configuration similar to that of the detection section SW7. The detection section SW8 is disposed at the lower section of a stop rail 81. The detection section SW8 can serve as the first detection section that maintains the ON state only when the damper lever 67 is located within 30% of the latter half of the turning stroke in the forward stroke direction.

The detection sections SW2 to SW6 may merely be configured so as to be able to detect the operation of the key K or the displacement member, and a configuration suited for the disposition location thereof can be adopted. For example, the detection sections SW5 and SW6 (FIG. 1) are disposed ahead of the key fulcrum section 70 and are turned ON when they are pressed down by the key K that is operated so as to be pressed down. Since the detection section SW5 protrudes higher than the detection section SW6, the detection section SW5 turns ON earlier than the detection section SW6 in the forward stroke of the key pressing operation.

As the detection sections SW2 to SW4, a switch having an ordinary switch configuration in which the state of the switch becomes ON by making contact with an object or by detecting the change in pressure may be adopted. However, in this embodiment, a configuration in which the engagement state of members is detected depending on the state of the electrical conduction between the members is taken as an example. More specifically, each of the engaged sections of the members being engaged with each other is configured so as to have conductivity, and a CPU 45 (FIG. 4A) detects the engagement state of the two by utilizing the fact that conduction occurs when the two make contact with each other and that non-conduction occurs when the two are separated.

In order that the above-mentioned conduction configuration is attained easily, for example, conductive materials are provided in the regions of the engaged sections being engaged with each other. As a conductive material, graphite, conductive rubber, conductive nonwoven fabric, copper plate, conductive coating (conductive grease) or the like is provided on at least the surfaces or the engagement faces in the regions of the engagement. In the case that cloth or the like is used, the entire cloth may be formed of a conductive material. Alternatively, the whole or at least the respective engaged sections of the movable members and the corresponding members may be made of a conductor or a conductive material. For example, the whole or the engaged sections of the members are formed of resin. The configuration for giving conductivity may be different between the movable members and the corresponding members.

Some typical examples are taken as described below. In the case of the detection section SW2, both the key K (the damper lever cushion 68 thereof) and the damper lever 67 (the contact section thereof) are made of conductors. In the case of the detection section SW3, both the regulating button 25 and the jack 6 are made of conductors. In the case of the detection section SW4, both the back rail cloth 65 and the key K (the conductive section 66 thereof) are made of conductors. A configuration similar to that described above is applicable to both the members other than these members. Both the jack 6 and the hammer roller 14 may be made of conductors.

The conductive sections having conductivity are electrically connected to the electric circuit boards. In FIG. 2, the electric circuit boards are not shown. As shown in FIG. 1, for example, the conductive section of the jack 6 is connected to an electric circuit board 62 with a wire 72, such as a flexible lead, and the hammer roller 14 is also connected to the electric circuit board 62 with a wire 73. Moreover, to the electric circuit board 61, the front bushing cloths 64A and 64B are connected with a wire 71, and the front punching cloths 63A and 63B are also connected with wires, not shown. The conductive sections of the other engaged sections are also connected as necessary to the electric circuit boards 61 and 62 or electric circuit boards, not shown, with wires.

Each detection section SW electrically turns ON when it becomes conductive and electrically turns OFF when it becomes non-conductive. In this embodiment, however, in the detection section SW relating to a displacement member, the case in which the detection section SW detects that the displacement member has been located at a position away from a certain position in the forward stroke direction in the forward stroke of the key is referred to as "an operation detection state." For example, in the detection sections SW7 and SW8, the state of being ON electrically corresponds to the operation detection state.

On the other hand, as in the detection section SW4, the back rail cloth 65 is separated from the conductive section 66 of the key K when the key is pressed even just a little bit, and the detection section SW4 turns OFF. In this type of detection section that turns ON electrically in the non-pressing state of the key, the key pressing operation is detected when the detection section electrically turns OFF. Hence, the state of being OFF electrically is referred to as "an operation detection state."

Figures 4A, 4B:
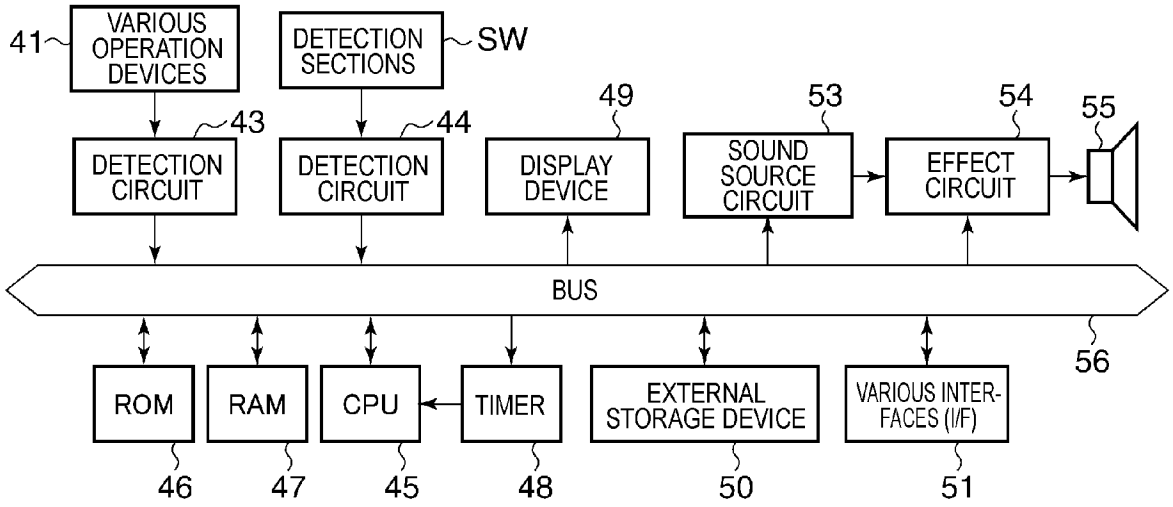
FIG. 4A is a block diagram showing the whole configuration of the keyboard unit.
FIG. 4B is a conceptual drawing indicating the information of the detection results in the detection sections, the information being stored in a register.

FIG. 4A is a block diagram showing the whole configuration of the keyboard unit. The keyboard unit has a configuration in which a detection circuit 43, a detection circuit 44, a ROM 46, a RAM 47, a timer 48, a display device 49, an external storage device 50, various interfaces (I/F) 51, a sound source circuit 53, and an effect circuit 54 are respectively connected to the CPU 45 via a bus 56.

Furthermore, the detection sections SW are connected to the detection circuit 44. Various operation devices 41 include playing operation devices, such as the key K. The timer 48 is connected to the CPU 45, and a sound system 55 is connected to the sound source circuit 53 via the effect circuit 54.

The detection circuit 43 detects the operation states of the various operation devices 41. The detection circuit 44 detects the conduction states of the detection sections SW and supplies the results of the detection to the CPU 45. The CPU 45 controls the whole unit. The ROM 46 stores control programs to be executed by the CPU 45, various table data, etc. The RAM 47 temporarily stores various input information, such as performance data and text data, various flags, buffer data, operation results, etc. The timer 48 counts an interruption time in timer interruption processing and various times. The various interfaces (I/F) 51 include a MIDI interface and a communication interface. The sound source circuit 53 converts performance data having been input from the various operation devices 41, preset performance data, etc. into musical sound signals. The effect circuit 54 gives various effects to musical sound signals to be input from the sound source circuit 53, and the sound system 55 including a DAC (digital-to-analog converter), an amplifier, speakers, etc. converts musical sound signals and the like to be input from the effect circuit 54 into sound.

FIG. 4B is a conceptual drawing indicating the information of the detection results in the detection sections SW, the information being stored in a register. The information of the detection results in the detection sections SW is information indicating ON/OFF conduction states and change times when ON/OFF switching has occurred, and the information for all the detection sections SW is stored in the register of the RAM 47 for each key K. However, the information on the detection sections SW in which the detection information is not used is not necessary to be stored.

Figure 5A:
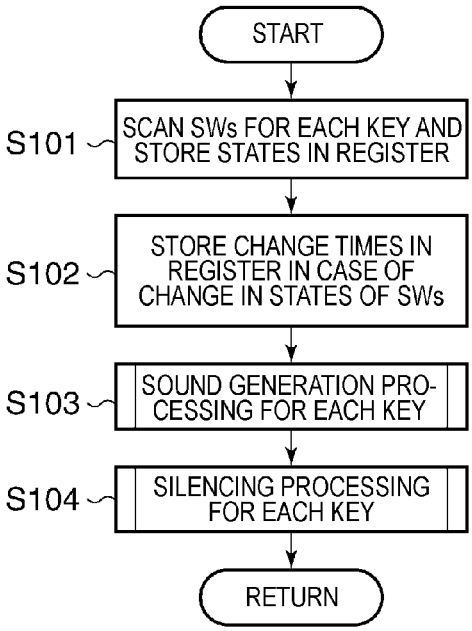
FIG. 5A is a flowchart showing main processing.

FIG. 5A is a flowchart showing main processing. This processing is executed at predetermined intervals (for example, every 100 μsec). First, the CPU 45 scans the detection sections SW for each key K and stores the results (ON or OFF) of the scanning in the register for each key K (at step S101). Next, in the case that the states of the detection sections SW have changed, that is, the ON/OFF states thereof have changed, the CPU 45 also stores the change times of the states (at step S102). Hence, the information (FIG. 4B) on the results of the detection is stored for each key K and renewed as necessary. The processing for scanning the detection sections SW and the processing for storing the states in the register may also be carried out sequentially and automatically by hardware.

Next, the CPU 45 carries out the sound generation processing for each key K (at step S103), and then carries out the silencing processing (FIG. 5B) for each key K (at step S104), thereby ending the processing shown in FIG. 5A.

Musical sound control can be carried out on the basis of the results of the detection of the plurality of detection sections SW. Furthermore, the results of the detection of the detection sections SW can be used for not only musical sound control, but also the recording of performance as performance data for musical sound control. The detection sections SW to be used for musical sound control and for the recording of performance data are not limited particularly. In other words, any detection sections SW may be adopted as detection sections SW for generating the musical sound information that is used to determine a sound generation trigger and the key pressing velocity. Moreover, any detection sections SW may be adopted as detection sections SW for the silencing of generated musical sound.

In this embodiment, an example in which both sound generation processing and silencing processing are carried out using the detection section SW7 will be described below as a representative. In this embodiment, the change in the operation direction of the hammer 11 serving as a displacement member from the forward stroke direction to the returning direction is used as the sound generation trigger and musical sound is generated.

Figure 5B:
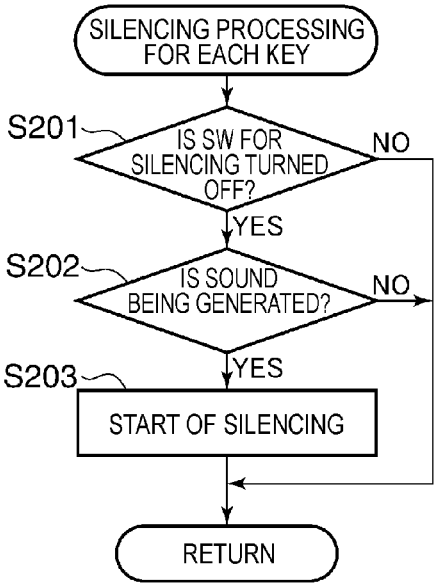
FIG. 5B is a flowchart showing silencing processing for each key.
Figure 6:
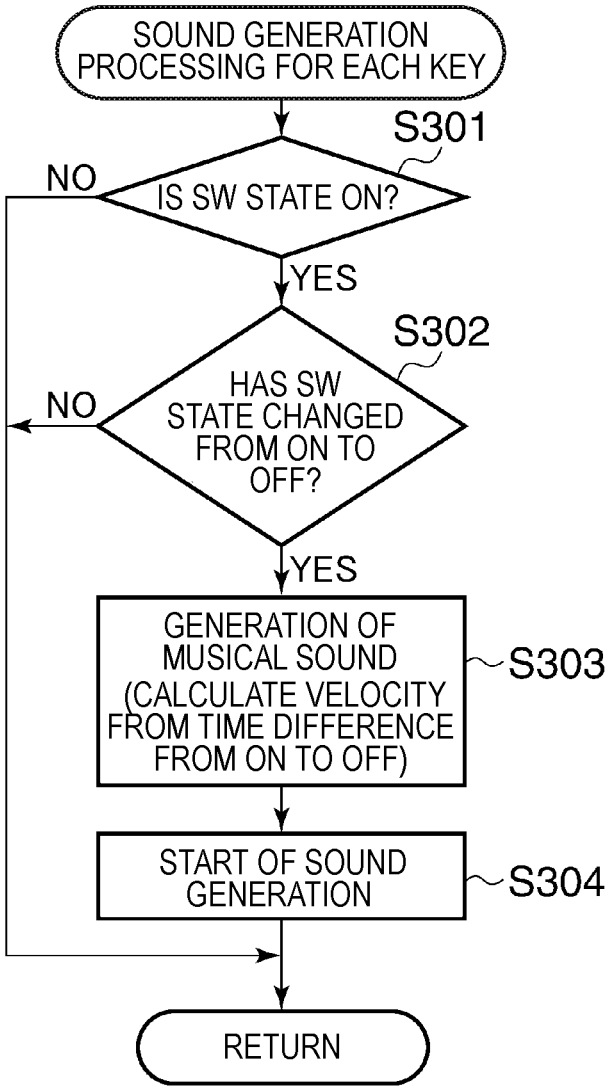
FIG. 6 is a flowchart showing sound generation processing for each key.

FIG. 5B is a flowchart showing silencing processing for each key K to be executed at step S104 in FIG. 5A. FIG. 6 is a flowchart showing sound generation processing for each key K to be executed at step S103 in FIG. 5A.

First, at step S301 in FIG. 6, the CPU 45 judges whether the state of the detection section SW7 is the operation detection state (ON). This judgment is made referring to the information (FIG. 4B) of the results of the detection and also made similarly at the following steps. In the case that the state of the detection section SW7 is not the operation detection state (ON) (the state is the operation non-detection state (OFF)) as the result of the judgment, the turning position of the hammer 11 is shallower than the predetermined position, and the current timing is not the timing at which sound should be generated, whereby the processing shown in FIG. 6 ends without sound generation.

On the other hand, in the case that the state of the detection section SW7 is the operation detection state (ON), it can be judged that the turning position of the hammer 11 is deeper than the predetermined position. Hence, the CPU 45 judges whether the state of the detection section SW7 has changed from the operation detection state (ON) to the operation non-detection state (OFF) (at step S302). In the case that the state of the detection section SW7 has not changed from the operation detection state (ON) as the result of the judgment, the bouncing back of the hammer 11, that is, the change from the forward stroke direction to the returning direction, has not yet been confirmed, and the current timing is not the timing at which sound should be generated, whereby the processing in FIG. 6 ends without sound generation.

On the other hand, in the case that the state of the detection section SW7 has changed from the operation detection state (ON) to the operation non-detection state (OFF), it can be judged that the operation direction of the hammer 11 has changed from the forward stroke direction to the returning direction, whereby the CPU 45 generates the musical sound information (at step S303). In the generation of the musical sound information, the CPU 45 determines the key pressing velocity on the basis of the time difference ΔT1 (see FIG. 3B) between the time of the ON operation and the time of the OFF operation of the detection section SW7. For example, the key pressing velocity is obtained by multiplying a coefficient to the reciprocal of the time difference ΔT1. The CPU 45 then starts sound generation on the basis of the generated musical sound information (at step S304). In other words, the CPU 45 controls the sound source circuit 53, the effect circuit 54, etc. so that the musical sound having the sound pitch of the key K to be processed in this processing is generated at the velocity currently determined for the key K. Hence, the timing when the operation direction of the hammer 11 has changed from the forward stroke direction to the returning direction is the sound generation timing at which sound generation starts. Then, the processing shown in FIG. 6 ends.

The musical sound information including the key pressing velocity, and the sound generation timing are herein collectively referred to as "sound generation indication information." The CPU 45 generates the sound generation indication information as clarified as described above. At the above-mentioned step S304, the CPU 45 controls the sound source circuit 53, the effect circuit 54, etc. on the basis of the generated sound generation indication information, thereby making the keyboard unit itself generate musical sound. However, the processing relating to the sound generation indication information is not limited to the above-mentioned processing. For example, the CPU 45 may output the generated sound generation indication information to an external device via the various interfaces (I/F) 51 and may allow the external device to generate musical sound on the basis of the sound generation indication information. Alternatively, the sound generation indication information may be stored in the external storage device 50 or the like.

In the silencing processing for each key K shown in FIG. 5B, at step S201, the CPU 45 judges whether the state of the detection section SW (the detection section SW7) for silencing is OFF. In the case that the state of the detection section SW7 is ON as the result of the judgment, the CPU 45 ends the processing shown in FIG. 5B without starting silencing. On the other hand, in the case that the state of the detection section SW7 is OFF, the CPU 45 advances the processing to step S202 and judges whether the sound pitch corresponding to the key K to be processed at this time is being generated. In the case that the sound pitch is not being generated as the result of the judgment, the CPU 45 ends the processing shown in FIG. 5B. On the other hand, in the case that the sound pitch is being generated, the CPU 45 starts silencing the musical sound being generated (at step S203).

Instead of the detection section SW7, any one of the detection sections SW2, SW5 and SW6 may be used as the detection section SW for silencing, and with this configuration, appropriate silencing control can be carried out in some occasions. For example, in the case that the detection section SW2 is adopted as the detection section SW for silencing, the separation of the damper lever cushion 68 from the damper lever (the contact section 67*a* thereof) becomes the silencing timing. In this case, the silencing timing almost coincides with the timing of the separation of the damper 79 from the string 19, whereby more natural silencing is carried out.

With this embodiment, the musical sound information is generated and sound generation is started when the change of the operation direction of the displacement member (the hammer 11) from the forward stroke direction to the returning direction is detected, whereby sound generation can be carried out while sound generation timing is determined appropriately. In particular, the first detection section (SW7) maintains the ON state only when the hammer 11 is located at a position deeper than the predetermined position (30%) in the stroke in the forward stroke direction, whereby the timing corresponding to the striking of the string can be used as the sound generation trigger. In addition, since the key pressing velocity is determined on the basis of the time difference ΔT1 between the time of the ON operation and the time of the OFF operation of the detection section SW7, the key pressing velocity can be determined appropriately and the musical sound information can be generated by using at least one detection section SW.

It is assumed that the first detection section (the detection section SW7) is set to the ON state only when the hammer 11 is located at a position deeper than the predetermined position in the stroke in the forward stroke direction. However, the "ON state" described above is not limited to electrical conduction. Hence, assuming that an electrical conduction state is OFF and that an electrical non-conduction state is ON, it may be possible to adopt such a detection section that is set to the electrical non-conduction state (that is, the ON state) only when the hammer is located at a position deeper than the predetermined position in the stroke in the forward stroke direction.

Even if the detection section SW8 is used instead of the detection section SW7 as the detection section SW for generating the musical sound information, sufficiently appropriate sound generation timing can be determined. In this case, the damper lever 67 serves as a displacement member. However, in a certain kind of displacement member, when the operation direction thereof changes from the forward stroke direction to the returning direction, the displacement member is not always limited to be bounced back by a stopper or the like but the operation direction thereof may change to the returning direction by gravity. Even in such a case, if the change to the returning direction is judged according to the result of the detection by the detection section SW for generating the musical sound information, it is possible to generate appropriate musical sound information.

Next, a modification of the first embodiment will be described referring to FIGS. 7A and 7B. In this modification, two detection sections SW (the detection sections SW5 and SW7) are used as detection sections SW for generating the musical sound information. As an example for explanation, the detection section SW7 is adopted as the first detection section, and as a key detection section for detecting that the key K has been pressed, the detection section SW5 is adopted. Hence, the modification of the first embodiment will be described by using FIG. 7A instead of FIG. 6 and by using FIG. 7B instead of FIG. 3B. Furthermore, the detection section SW5 is adopted as the detection section SW for silencing. Consequently, at step S201 in FIG. 5A, a judgment is made as to whether the detection section SW5 is OFF.

Figure 7A:
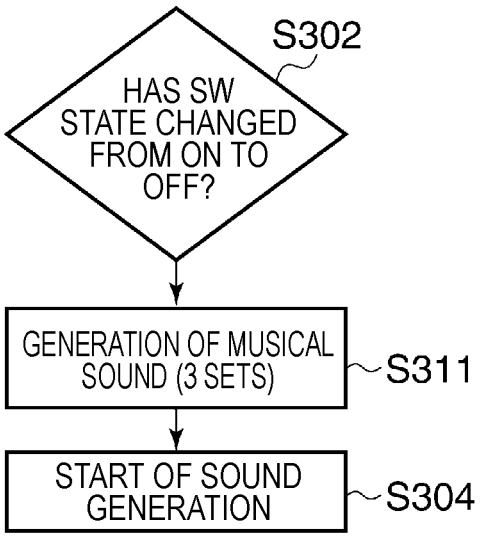
FIG. 7A is a flowchart showing sound generation processing for each key according to a modification of the first embodiment.
Figure 7B:
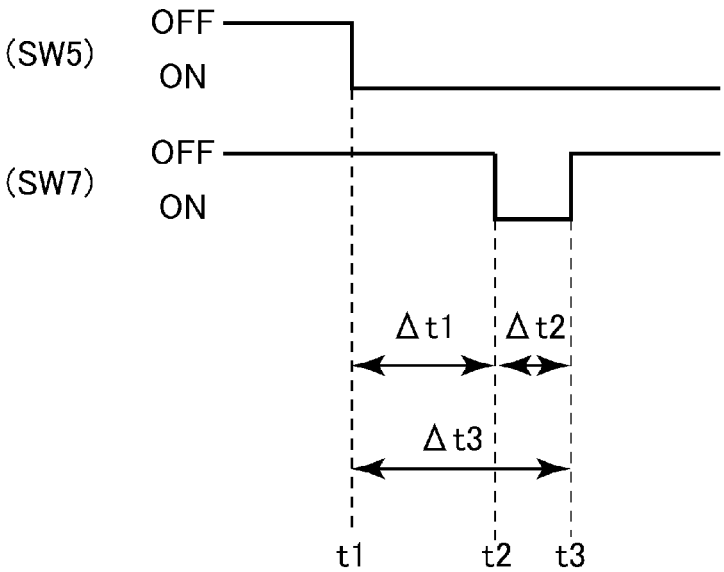
FIG. 7B is a time chart indicating the operation detection states of the detection sections.

FIG. 7A is a flowchart showing sound generation processing for each key K to be executed at step S103 in FIG. 5A. In FIG. 7A, step S311 is executed instead of step S303 in FIG. 6 although some steps in FIG. 6 are not shown. Steps S301, S302 and S304 are the same as those shown in FIG. 6.

At step S311, the CPU 45 generates the musical sound information on the basis of the ON state of the detection section SW5 and the ON and OFF states of the detection section SW7. FIG. 7B is a time chart indicating the operation detection states of the detection sections SW5 and SW7. It is assumed that the time when the detection section SW5 turns ON (the time when the key detection section detects the pressing of the key K) is t1, that the time when the detection section SW7 turns ON is t2, and that the time when the state of the detection section SW7 changes from ON to OFF is t3. It is also assumed that the time difference between time t1 and time t2 is Δt1, that the time difference between time t2 and time t3 is Δt2, and that the time difference between time t3 and time t1 is Δt3.

The CPU 45 determines the key pressing velocity on the basis of at least any one of the time differences Δt1, Δt2 and Δt3. Although the method for the determination is not limited, for example, any one (for example, the shortest time difference) of the time differences Δt1, Δt2 and Δt3 is selected, and the key pressing velocity is obtained by multiplying a coefficient to the reciprocal of the time difference. Alternatively, on the basis of the values obtained by multiplying predetermined coefficients to two or three of the time differences Δt1, Δt2 and Δt3, the key pressing velocity is calculated using a calculation expression.

As described above, with the modification, both the first detection section (SW7) and the key detection section (SW5) are used and the key pressing velocity is determined on the basis of at least any one of the time differences Δt1, Δt2 and Δt3. Hence, the key pressing velocity can be determined appropriately by using at least two detection sections SW.

(Second Embodiment)

In the first embodiment, the first detection section (the detection section SW7) for detecting that the operation direction of the displacement member (the hammer 11) has changed from the forward stroke direction to the returning direction is used for generating the musical sound information. On the other hand, in a second embodiment according to the present invention, "a second detection section" that turns ON each time the displacement member (the hammer 11) passes through a predetermined position in the forward stroke direction or the returning direction is used. Hence, the second embodiment will be described referring to FIGS. 3C, 3D, 8 and 9 instead of FIGS. 3A, 3B, 6 and 7.

FIG. 3C is a front view showing a configuration of the detection section according to the second embodiment. The detection section SW7*b* shown in the figure serves as the second detection section. The detection section SW7*b* is configured as a photo-interrupter type optical sensor formed of a pair of a light-emitting section 83 and a light-receiving section 84. When the hammer 11 has passed through the optical path from the light-emitting section 83 to the light-receiving section 84, the state of the detection section SW7*b* becomes the operation detection state (ON). The light-emitting section 83 and the light-receiving section 84 are located at the same height and below the lower face of the silencing stopper 60. When the hammer 11 is further turned in the forward stroke direction from the position of the light-emitting section 83 and becomes away from the optical path, the state of the detection section SW7*b* becomes the operation non-detection state (OFF). Hence, the detection section SW7*b* can detect that the hammer 11 has passed through the optical path but cannot detect the passing direction of the hammer 11. In the stroke of the hammer 11 in the forward stroke direction, the stroke ST1 from the light-emitting section 83 to the lower face of the silencing stopper 60 is located within 30% of the whole stroke ST0 of the hammer 11.

Figure 8:
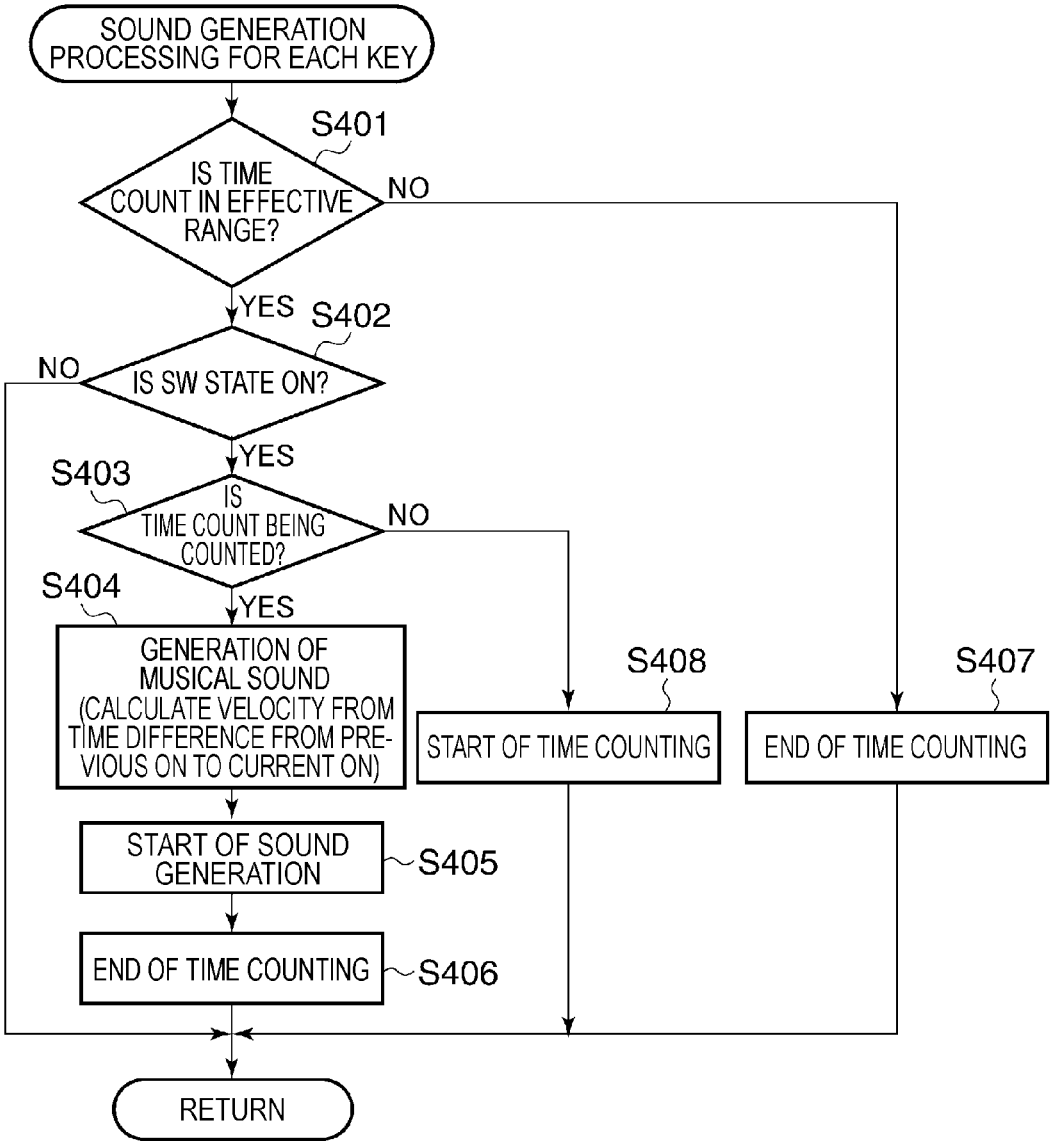
FIG. 8 is a flowchart showing sound generation processing for each key.

First, an example in which both sound generation processing and silencing processing are carried out using the detection section SW7*b* will be described. FIG. 8 is a flowchart showing sound generation processing for each key K to be executed at step S103 in FIG. 5A.

The CPU 45 judges whether time count Tcnt is in an effective range, (at step S401). For the time count Tcnt, counting starts at step S408. In the case that the time count Tcnt is not counted or Tcnt≥0, it is judged that the time count Tcnt is in the effective range.

In the case that time count Tcnt is not in the effective range as the result of the judgment, the CPU 45 advances the processing to step S407 and ends the counting of the time count Tcnt being counted and ends the processing shown in FIG. 8. On the other hand, in the case that the time count Tcnt is in the effective range, the CPU 45 judges whether the state of the detection section SW7*b* has become the operation detection state (ON) (at step S402). In the case that the state of the detection section SW7*b* has not become the operation detection state (ON) (the state is the operation non-detection state (OFF)) as the result of the judgment, the turning position of the hammer 11 is shallower than the predetermined position, and the current timing is not the timing at which sound should be generated, whereby the processing shown in FIG. 8 ends without sound generation.

On the other hand, in the case that the state of the detection section SW7*b* has become the operation detection state (ON), the CPU 45 judges whether the time count Tcnt is being counted currently (at step S403). In the case that the time count Tcnt is not being counted as the result of the judgment, the CPU 45 sets an initial value in the time count Tcnt and starts counting down (at step S408) and ends the processing shown in FIG. 8. On the other hand, in the case that the time count Tcnt is being counted, it can be judged that the operation direction of the hammer 11 has changed from the forward stroke direction to the returning direction. Hence, the CPU 45 generates the musical sound information (at step S404).

In the generation of the musical sound information, the CPU 45 determines the key pressing velocity on the basis of the time difference ΔT2 (see FIG. 3D) between the time of the first ON operation and the time of the second ON operation of the detection section SW7*b*. If the time count Tcnt is not in the effective range, the processing does not advance to step S404. Hence, the generation of the musical sound information is carried out only in the case that the second ON operation is done within a certain time that is determined by an initial value to be set in the time count Tcnt after the first ON operation of the detection section SW7*b*.

Next, the CPU 45 starts sound generation on the basis of the generated musical sound information (at step S405). In other words, the CPU 45 controls the sound source circuit 53, the effect circuit 54, etc. so that the musical sound having the sound pitch of the key K to be processed in this processing is generated at the velocity currently determined for the key K. Hence, the timing of the change in the operation direction of the hammer 11 from the forward stroke direction to the returning direction becomes the timing for the start of sound generation. Then, the CPU 45 ends the counting of the time count Tcnt (at step S406) and ends the processing shown in FIG. 8.

With this embodiment, the timing of the second ON operation in the case that the second detection section (the detection section SW7*b*) has turned ON two times in succession within the certain time is used as the timing for sound generation. Hence, the timing for sound generation can be determined appropriately even in the case that a detection section that cannot detect the passing direction is used. In addition, effects similar to those obtained in the first embodiment can be provided in using the timing corresponding to string striking as the sound generation trigger, in appropriately determining the key pressing velocity and in generating the musical sound information using at least one detection section SW.

Even if the detection section SW8 is used as a detection section SW for generating the musical sound information, in the case that a configuration similar to that of the detection section SW7*b* is applied to the detection section SW8, sufficiently appropriate sound generation timing can be determined. In this case, the damper lever 67 serves as a displacement member.

Next, a modification of the second embodiment will be described referring to FIG. 9. In this modification, two detection sections SW (the detection sections SW5 and SW7*b*) are used as the detection sections SW for generating the musical sound information. As an example for explanation, the detection section SW7*b* is adopted as the second detection section, and as a key detection section for detecting that the key K has been pressed, the detection section SW5 is adopted. Hence, in the second embodiment, the modification of the second embodiment will be described by using FIG. 9A instead of FIG. 8 and by using FIG. 9B instead of FIG. 3D. Furthermore, the detection section SW5 is adopted as the detection section SW for silencing. Consequently, at step S201 in FIG. 5A, a judgment is made as to whether the detection section SW5 is OFF.

Figure 9A:
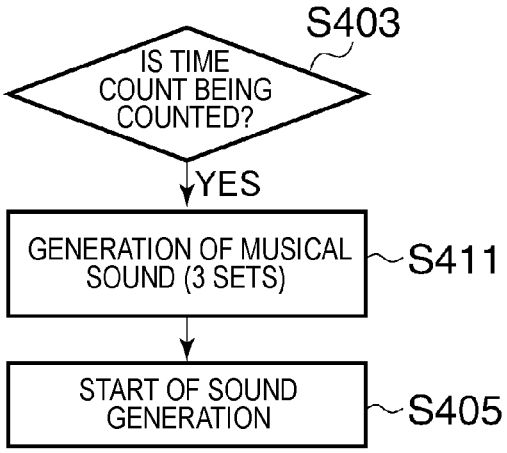
FIG. 9A is a flowchart showing sound generation processing for each key according to a modification of the second embodiment.
Figure 9B:
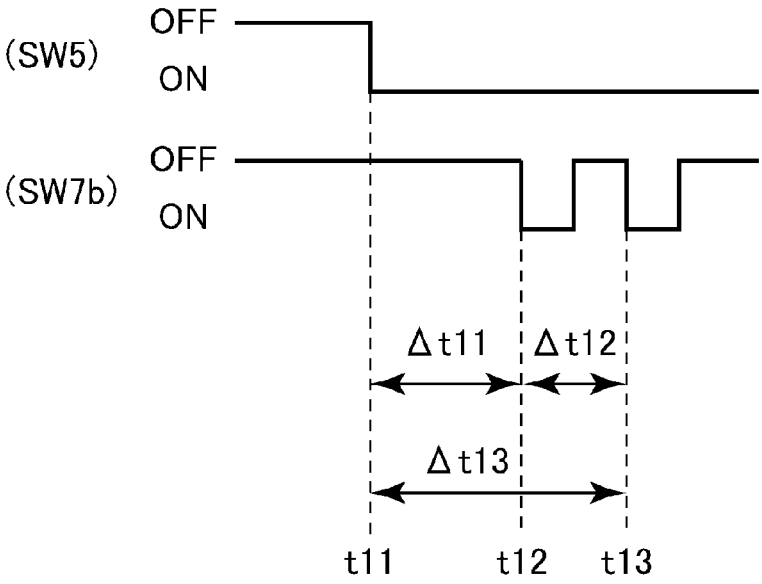
FIG. 9B is a time chart indicating the operation detection states of the detection sections.

FIG. 9A is a flowchart showing sound generation processing for each key K to be executed at step S103 in FIG. 5A. In FIG. 9A, step S411 is executed instead of step S404 shown in FIG. 8 although some of steps in FIG. 8 are not shown. Steps S401 to S403 and S405 to S408 are the same as those shown in FIG. 8.

At step S411, the CPU 45 generates the musical sound information on the basis of the ON state of the detection section SW5 and the ON and OFF states of the detection section SW7*b*. FIG. 9B is a time chart indicating the operation detection states of the detection sections SW5 and SW7*b*. It is assumed that the time when the detection section SW5 turns ON (the time when the key detection section detects the pressing of the key K) is t11, that the time when the detection section SW7*b* turns ON at the first time is t12, and that the time when the detection section SW7*b* turns ON at the second time after the ON operation of the first time is t13. It is also assumed that the time difference between time t11 and time t12 is Δt11, that the time difference between time t12 and time t13 is Δt12, and that the time difference between time t11 and time t13 is Δt13.

The CPU 45 determines the key pressing velocity on the basis of at least any one of the time differences Δt11, Δt12 and Δt13. The method for the determination is not limited, and it can be assumed that the method is similar to that used at step S311 in FIG. 7.

As described above, with the modification, both the second detection section (SW7*b*) and the key detection section (SW5) are used and the key pressing velocity is determined on the basis of at least any one of the time differences Δt11, Δt12 and Δt13. Hence, the key pressing velocity can be determined appropriately by using at least two detection sections SW.

Although the detection section SW7 is taken as an example of the first detection section in the first embodiment, the first detection section is not limited to this detection section. Since the first detection section is merely required to be configured so as to maintain the ON state only when the displacement member (the hammer 11 or the like) is located at a position shallower than the predetermined position, the first detection section may be a leaf switch or may be an optical sensor disposed so that the ON state thereof is maintained during the time from the middle of the turning to the end of the turning of the displacement member. On the other hand, although the detection section SW7*b* is taken as an example of the second detection section in the second embodiment, the second detection section is not limited to this detection section. Since the second detection section is merely required to be configured so as to turn ON each time the displacement member (the hammer 11 or the like) passes through the predetermined position in the forward stroke direction or the returning direction, a magnet type or a vibration detection type may be adopted as the second detection section.

In the second embodiment, a detection section being configured so as to turn OFF each time the displacement member (the hammer 11 or the like) passes through the predetermined position in the forward stroke direction or the returning direction may be adopted as the second detection section. In that case, the timing of the second OFF operation in the case that the second detection section has turned OFF two times in succession within a certain time may merely be used as the sound generation timing.

Although the detection section SW5 is taken as an example of the key detection section in the respective modifications of the first and second embodiments, another detection section SW (the detection section SW6 or the like) may also be used as the key detection section because the detection section is merely required to be able to detect that the key K has been pressed.

Furthermore, in the first and second embodiments, at the time of the generation of the musical sound information, not only the key pressing velocity but also tone may be determined on the basis of the time differences ΔT1 and ΔT2 and the time differences Δt1, Δt2, Δt3, Δt11, Δt12 and Δt13.

In the respective embodiments described above, although application of the keyboard unit according to the present invention to the keyboard musical instrument having the grand piano type action mechanism ACT is taken as an example, the configuration of the keyboard unit according to the present invention is not limited to such a configuration having the action mechanism ACT. In other words, the keyboard unit may merely have a displacement member that is displaced (moved) in the forward stroke direction and the returning direction by key pressing/releasing operation and may not be required to have the action mechanism.

Figure 10:
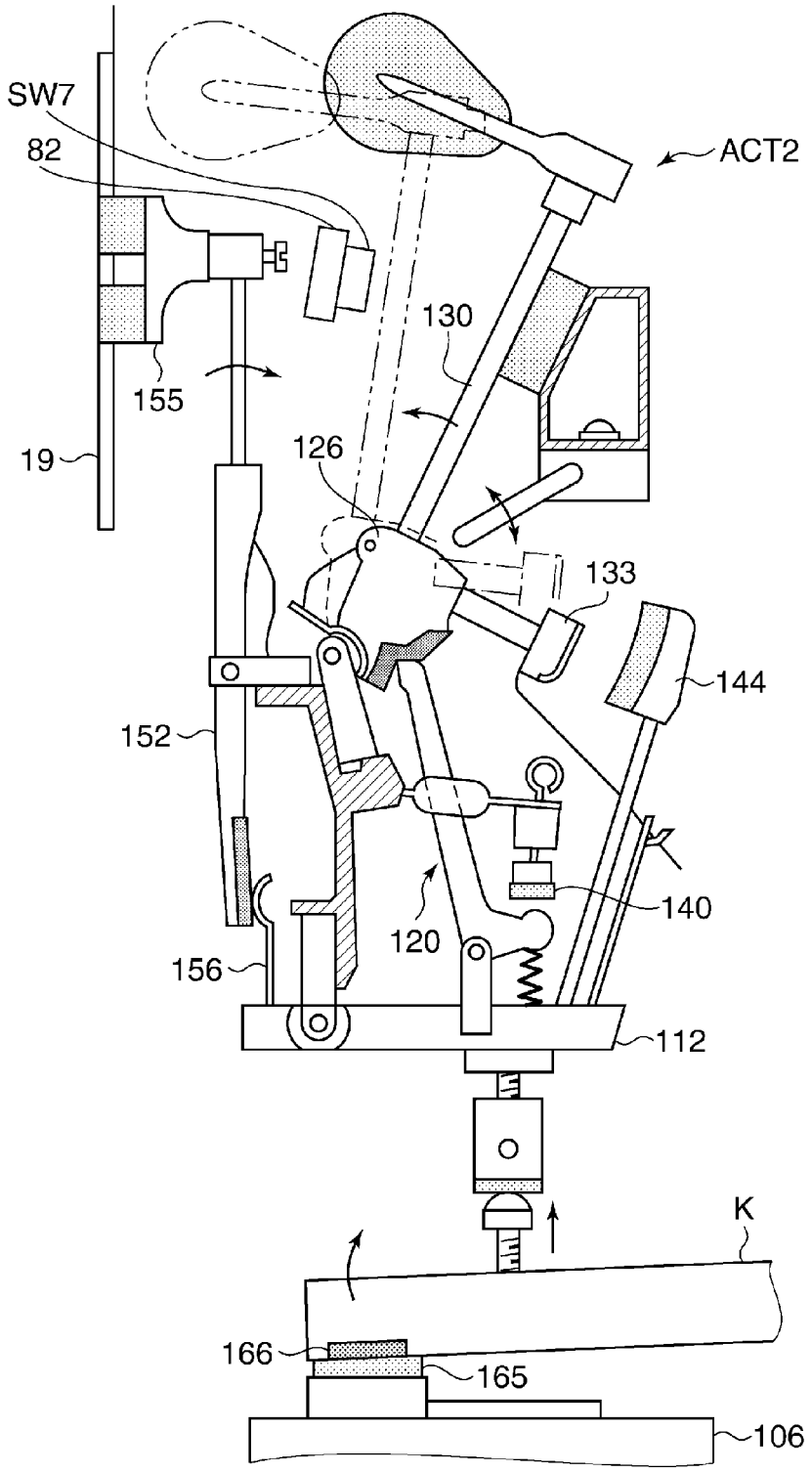
FIG. 10 is a side view showing the action mechanism of an upright piano.

Furthermore, the keyboard unit according to the present invention is also applicable to a keyboard musical instrument having an upright type action mechanism ACT shown in FIG. 10.

FIG. 10 is a side view showing the action mechanism ACT2 of an upright piano. In normal key pressing operation, when the key K is pressed down, a wippen 112 is pushed up and turned, whereby a jack 120 is raised. When the jack 120 is raised, a bat 126 is pushed up by the jack 120, whereby a hammer 130 is turned counterclockwise as shown in FIG. 10. The jack 120 is raised and turned. In the middle of being raised and turned, the jack 120 makes contact with a regulating button 140 and is turned clockwise, thereby escaping temporarily from the lower section of the bat 126. Moreover, when the wippen 112 is raised and turned, a damper spoon 156 turns a damper lever 152 clockwise, whereby a damper 155 is separated from the string 19.

After the damper 155 is separated from the string 19, the hammer 130 strikes the string 19. The hammer 130 is then bounced back, and a catcher 133 is elastically received by a back check 144. The jack 120 is released from the regulating button 140 by the turning and lowering of the wippen 112 accompanied by key releasing operation, whereby the jack 120 is turned and then returned to its original position, and the upper end of the jack 120 again enters the lower section of the bat 126. Hence the next string striking operation can be carried out using the same key K.

A key back rail cloth 165 is disposed so as to be fastened to a shelf board 106, and a conductive section 166 is provided at the rear lower section of the key K. Like the silencing stopper 60, a silencing stopper 82 is configured so that its position can be switched for use in the silencing mode.

In the above-mentioned configuration, for example, the silencing stopper 82 may be provided with the detection section SW7 (or the detection section SW7*b*). In the stroke of the hammer 130 in the forward stroke direction, the setting of the position in which the detection section SW7 turns ON is similar to that described in the first embodiment, and the position is located within 30% of the whole stroke ST0 of the hammer 130. Furthermore, the detection sections SW may be provided between the bat 126 and the jack 120, between the regulating button 140 and the jack 120, between the lower face (the conductive section 166 thereof) of the key K and the key back rail cloth 165, etc.

According to an aspect of the present invention, the sound generation timing can be determined appropriately.

In the invention, the detector may include a first detection section which maintains ON state only when the displacement member is located at a position deeper than a predetermined position in an operation range of the displacement member in the forward stroke direction, and the generator may be configured to determine a timing at which the first detection section turns from ON to OFF, as a sound generation timing. In this case, for example, the timing corresponding to string striking is used as the sound generation trigger.

In the invention, the generator may be configured to determine a key pressing velocity of the key based on a time difference from a time when the first detection section turns ON to a time when the first detection section tunes from ON to OFF. Further, the generator may be configured to determine a key pressing velocity based on a time difference from a time when the second detection section turns ON first to a time when the second detection section turns ON second, within the certain time. In these cases, the key pressing velocity can be determined appropriately.

In the invention, the keyboard unit may further comprise: a key detection section which is configured to detect that the key has been pressed. The generator may be configured to determine a key pressing velocity based on at least one of: a time difference from a time when the key detection section detects the pressing operation of the key to a time when the first detection section turns ON; a time difference from a time when the key detection section detects the pressing operation of the key to a time when the first detection section turns from ON to OFF; and a time difference from a time when the first detection section turns ON to a time when the first detection section tunes from ON to OFF, after the key detection section detects the pressing operation of the key. Further, the keyboard unit may further comprise: a key detection section which is configured to detect that the key has been pressed. The generator may be configured to determine a key pressing velocity based on at least one of: a time difference from a time when the key detection section detects the pressing operation of the key to a time when the second detection section turns ON first; a time difference from a time when the key detection section detects the pressing operation of the key to a time when the second detection section turns ON second; and a time difference from a time when the second detection section turns ON first to a time when the second detection section turns ON second, within the certain time, after the key detection section detects the pressing operation of the key. In these cases, the key pressing velocity can be determined appropriately by using at least two detection sections.

In the invention, the detector may include a second detection section which turns ON each time the displacement member passes through a predetermined position in the forward stroke direction or the returning direction, and in a case that the second detection section has turned ON two times in succession within a certain time, the generator may be configured to determine a timing at which the second detection section turns ON second, as a sound generation timing. In this case, the sound generation timing can be determined appropriately even in the case that a detection section incapable of detecting the passing direction is used.

In the invention, an operation end position of the displacement member in the forward stroke direction may be restricted by a restricting member, and the predetermined position may be located closer to an operation start position of the displacement member than the operation end position in the operation range of the displacement member in the forward stroke direction, and be located within 30% of the operation range from the operation end position. In this case, the sound generation timing can be determined more appropriately.

Although the present invention has been described above on the basis of the preferred Embodiments thereof, the present invention is not limited to these specific embodiments, but various embodiments within the scope not departing from the gist of the present invention are also included in the present invention. Some parts of the above-mentioned embodiments may be combined appropriately.

What is claimed is:

1. A keyboard unit comprising:

a key;

a displacement member configured to be driven directly or indirectly with the key by a pressing operation of the key to be moved in a forward stroke direction;

a detector configured to detect that an operation direction of the displacement member has changed from the forward stroke direction to a returning direction; and a generator configured to generate sound generation indication information based on information detected by the detector, wherein the detector includes a first detection section that maintains ON state only when the displacement member is located at a position deeper than a predetermined position in an operation range of the displacement member in the forward stroke direction, and wherein the generator is further configured to determine a timing at which the first detection section turns from ON to OFF, as a sound generation timing.

2. The keyboard unit according to claim 1, wherein the generator is further configured to determine a key pressing velocity of the key based on a time difference from a time when the first detection section turns ON to a time when the first detection section tunes from ON to OFF.

3. The keyboard unit according to claim 1, further comprising:

a key detection section configured to detect that the key has been pressed, wherein the generator is further configured to determine a key pressing velocity based on at least one of:

a time difference from a time when the key detection section detects the pressing operation of the key to a time when the first detection section turns ON;

a time difference from a time when the key detection section detects the pressing operation of the key to a time when the first detection section turns from ON to OFF; or a time difference from a time when the first detection section turns ON to a time when the first detection section tunes from ON to OFF, after the key detection section detects the pressing operation of the key.

4. The keyboard unit according to claim 1, wherein:

the detector includes a second detection section that turns ON each time the displacement member passes through a predetermined position in the forward stroke direction or the returning direction, and in a case where the second detection section has turned ON two times in succession within a certain time, the generator is further configured to determine a timing at which the second detection section turns ON second, as a sound generation timing.

5. The keyboard unit according to claim 4, wherein the generator is further configured to determine a key pressing velocity based on a time difference from a time when the second detection section turns ON first to a time when the second detection section turns ON second, within the certain time.

6. The keyboard unit according to claim 4, further comprising:

a key detection section which is configured to detect that the key has been pressed, wherein the generator is configured to determine the key pressing velocity based on at least one of:

a time difference from a time when the key detection section detects the pressing operation of the key to a time when the second detection section turns ON first;

a time difference from a time when the key detection section detects the pressing operation of the key to a time when the second detection section turns ON second; or a time difference from a time when the second detection section turns ON first to a time when the second detection section turns ON second, within the certain time, after the key detection section detects the pressing operation of the key.

7. The keyboard unit according to claim 1, wherein:

an operation end position of the displacement member in the forward stroke direction is restricted by a restricting member, and the predetermined position is located closer to an operation start position of the displacement member than the operation end position in the operation range of the displacement member in the forward stroke direction, and is located within 30% of the operation range from the operation end position.

8. The keyboard unit according to claim 1, wherein musical sound is generated based on the sound generation indication information generated by the generator.

9. The keyboard unit according to claim 1, wherein the sound generation indication information generated by the generator is output to an external device.

10. The keyboard unit according to claim 1, wherein the sound generation indication information generated by the generator is stored in a storage.

11. A keyboard musical instrument comprising:

a speaker; and a keyboard unit comprising:

a key;

a displacement member configured to be driven directly or indirectly with the key by a pressing operation of the key to be moved in a forward stroke direction;

a detector configured to detect that an operation direction of the displacement member has changed from the forward stroke direction to a returning direction; and a generator configured to generate sound generation indication information based on information detected by the detector, wherein the detector includes a first detection section that maintains ON state only when the displacement member is located at a position deeper than a predetermined position in an operation range of the displacement member in the forward stroke direction, and wherein the generator is further configured to determine a timing at which the first detection section turns from ON to OFF, as a sound generation timing.

12. A keyboard unit comprising:

a key;

a hammer configured to be driven directly or indirectly with the key by a pressing operation of the key to be moved in a forward stroke direction;

a detection section configured to detect that an operation direction of the hammer has changed from the forward stroke direction to a returning direction; and a control circuit configured to generate sound generation indication information based on information relating to the hammer and detected by the detection section, wherein the detection section maintains ON state only when the displacement member is located at a position deeper than a predetermined position in an operation range of the hammer in the forward stroke direction, and wherein the control circuit is further configured to determine a timing at which the first detection section turns from ON to OFF, as a sound generation timing.

* * * * *